United States Patent [19]

Matsuo

[11] Patent Number: 4,693,538

[45] Date of Patent: Sep. 15, 1987

[54] INSULATOR FOR ELECTRIC TERMINAL ATTACHED TO ELECTRIC WIRE

[75] Inventor: Hiroyoshi Matsuo, Chigasaki, Japan

[73] Assignee: Shiba Seisakusho Limited Responsibility Company, Ebina, Japan

[21] Appl. No.: 859,157

[22] Filed: May 2, 1986

[51] Int. Cl.[4] ..... H01R 13/422; H01R 13/58; H01R 17/04

[52] U.S. Cl. ..... 439/460; 24/130; 248/74.2; 439/672; 439/740

[58] Field of Search ..... 339/103 R, 103 B, 151 C, 339/155 L, 154 L, 171, 176 L, 181 R, 189 L, 177 L, 182 L, 184 L, 185 RL, 217 R; 24/129 R, 130, 115 H; 248/74.2

[56] References Cited

U.S. PATENT DOCUMENTS

| | | | |
|---|---|---|---|
| 160,705 | 3/1875 | Patterson | 24/130 |
| 3,135,535 | 6/1964 | Shepard | 339/103 B |
| 3,434,137 | 3/1969 | Rueger | 339/103 R |

FOREIGN PATENT DOCUMENTS

| | | | |
|---|---|---|---|
| 468670 | 1/1952 | Italy | 339/189 L |
| 639028 | 5/1962 | Italy | 339/176 L |
| 410099 | 10/1966 | Switzerland | 339/103 B |

*Primary Examiner*—Gil Weidenfeld
*Assistant Examiner*—Gary F. Paumen
*Attorney, Agent, or Firm*—Frank J. Jordan; C. Bruce Hamburg; Manabu Kanesaka

[57] ABSTRACT

Insulator for an electric terminal attached to an electric wire includes a cylindrical member having a hole, and a flange having a hole aligned with the hole of the cylinder member, a cutout provided at a peripheral portion or a large diameter hole provided adjacent to the hole to pass the wire, and a passage provided between the cutout or the later hole and the former hole to move the wire to the former hole by pressing the same. The wire attached the terminal is inserted into the cutout or the latter hole and is moved to the former hole through the passage and the terminal is fitted in the aligned hole of the flange by pulling the wire.

10 Claims, 19 Drawing Figures

INSULATOR FOR ELECTRIC TERMINAL ATTACHED TO ELECTRIC WIRE

BACKGROUND OF THE INVENTION

This invention relates to an improvement in an insulator for an electric terminal attached to an electric wire.

In a conventional insulator for an electric terminal to use in a socket disposed at an end of wiring in an automobile, the insulator comprises a cylindrical member which has a hole to insert an electric wire, and a flange which is projected from an end of the cylindrical member as one body and has a hole aligned with the hole of the cylindrical member to hold an electric terminal at a center portion. In case that an electric terminal is attached to an end of an electric source from a direction of an electric wire which was cut at predetermined size, the other free end of the wire which is not attached to an electric terminal is inserted into and is drawn out from the hole of the cylindrical member and the flange, and the terminal is attached and fixed on the free end of the wire. And then, the wire is pulled to dispose and hold the terminal in the hole to operably contact with an end contact of a bulb or lamp. Therefore, it requires much labor to dispose the terminal on the insulator and it is impossible to mass-produce and assemble it at a low cost.

SUMMARY OF THE INVENTION

The present invention provides a new and more efficient insulator for an electric terminal attached to an electric wire. The insulator of the present invention comprises a cylindrical member which has at least one hole, and a flange which is formed in one united body with the cylindrical member and has a hole aligned to the hole of the cylindrical member. A cutout or a large diameter hole is provided in the flange, through which the wire is able to be passed to the hole of the cylindrical member, and a passage is provided between the hole and the cutout or the large diameter hole in the flange, through which the wire is moved by pressure applied thereto.

The wire is inserted and passed through the cutout or the large diameter hole, and is moved to the hole through the passage by pushing. After placing the wire in the hole, the wire is pulled, and the terminal is fitted in the hole and a head of the terminal is stably held in the aligned hole of the flange.

It is one object of the present invention to overcome the above disadvantage of the prior art and to provide an insulator to stably hold an electric terminal attached to an electric wire before or after assembling the insulator in a socket.

Another object of the present invention is to provide an insulator for an electric terminal attached to an end of an electric wire having a cylindrical member which has at least one hole, and a flange which has a hole aligned to the hole of the cylindrical member and a cutout and at least one passage connected to the hole and the cutout to insert and pass the electric wire to the hole of the cylindrical member.

A still another object of the invention is to provide an insulator for an electric terminal attached to an end of an electric wire having a cylindrical member which has at least one hole, and a flange which has a hole aligned to the hole of the cylindrical member and a large diameter hole to pass the electric terminal and a passage between the large diameter hole and the small diameter hole of the cylindrical member, the passage having width to allow the electric wire to pass therethrough by pressure applied to the wire.

A further object and many of the attendant advantages of the present invention will be readily appreciated as the same becomes better understood by reference to the following description when read in conjunction with the accompanying drawings.

BRIEF DESCRIPTION OF THE DRAWINGS

The accompanying drawings illustrate the preferred embodiments of the present invention.

THE DETAILED DESCRIPTION OF THE INVENTION

Figure 1:
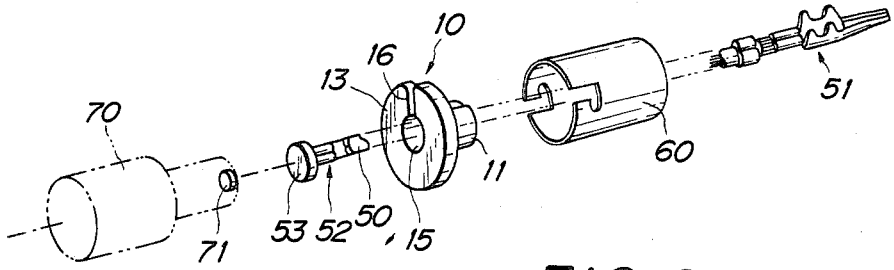
FIG. 1 is an exploded perspective view of an insulator of a first embodiment of the present invention.
Figure 2:
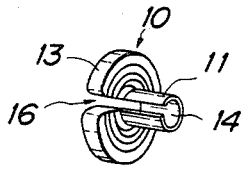
FIG. 2 is a perspective view of the insulator shown in FIG. 1.
Figure 3:
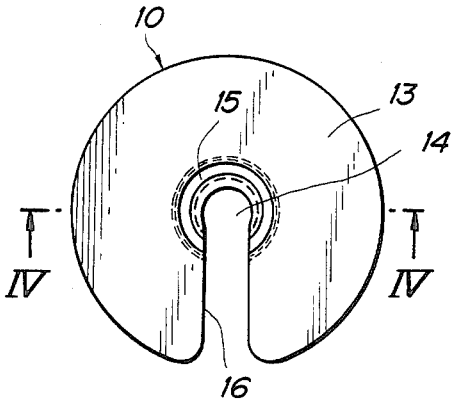
FIG. 3 is a top plan view of the insulator.
Figure 5:
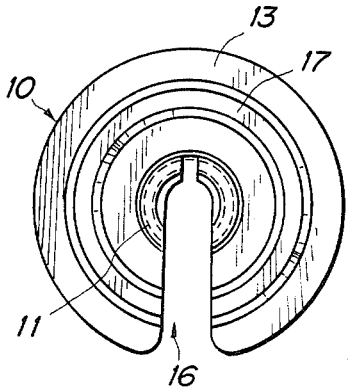
FIG. 5 is a bottom view of the insulator.

Referring to the drawings, an insulator of the present invention holds an electric terminal 52, wherein electric terminals 51 and 52 are attached to both ends of an electric wire 50. FIGS. 1, 2, 3, 4, 5 and 6 illustrate a first embodiment of an insulator 10 of the present invention. The insulator 10 comprises a cylindrical member 11 which has a hole 14, and a flange 13 which is formed at an end of the cylindrical member 11 integrally therewith and has a hole 15 aligned to the hole 14 of the cylindrical member 11. A cutout 16 is provided, which extends from a peripheral portion of the flange 13 to the side portion of the cylindrical member 11 to communicate with the hole 14. The wire 50 is inserted to the hole 14 of the cylindrical member 11 through the cutout 16 by pushing the wire 50. An annular projection 12 is provided on an inner peripheral wall of the hole 14 of the cylindrical member 11 to prevent the wire 50 from slipping and falling out to a direction of the flange 13.

Figure 4:
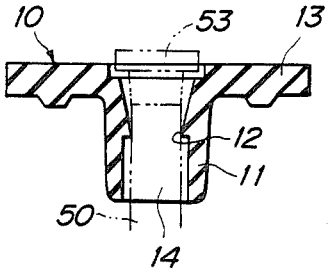
FIG. 4 is a vertical sectional view along IV—IV line in FIG. 3.
Figure 6:
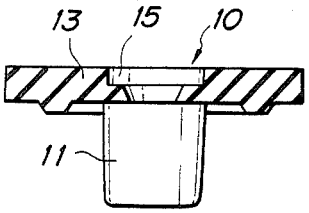
FIG. 6 is a partially sectional fragmentary schematic illustration of the insulator.

The hole 14 has a diameter to pass the wire 50, but not to pass the terminal 52 thereof, namely the diameter of the hole 14 is smaller than a diameter of the terminal head 53 which is disposed to align with the hole 15 of the flange in case that the head 53 of the terminal 50 is held as shown by phantom lines in FIG. 4. For example, the head 53 of the terminal 52 is contacted to an end contact 71 of a bulb 70 or lamp shown in FIG. 1.

By provision of the cutout 16, the wire 50 is disposed in the hole 14 of the cylindrical member 11 through the cutout 16, even though the terminals 51 and 52 which have each diameter not to pass the hole 14 are respectively attached to both ends of the wire 50 prior to disposition of the wire 50 to the insulator 10. Therefore, it is possible to automatically attach and fix the terminals 51 and 52 to the ends of the wire 50 prior to disposition of the wire 50 to the insulator 10 without any restriction that the terminals are attached to the ends of the wire after insertion into a hole of a conventional insulator. And, by the annular projection 12 provided to the inner peripheral wall of the hole 14 of the cylindrical member 11, the wire is certainly held to the insulator 10 not to accidentally slip out from the hole 14.

Figure 7:
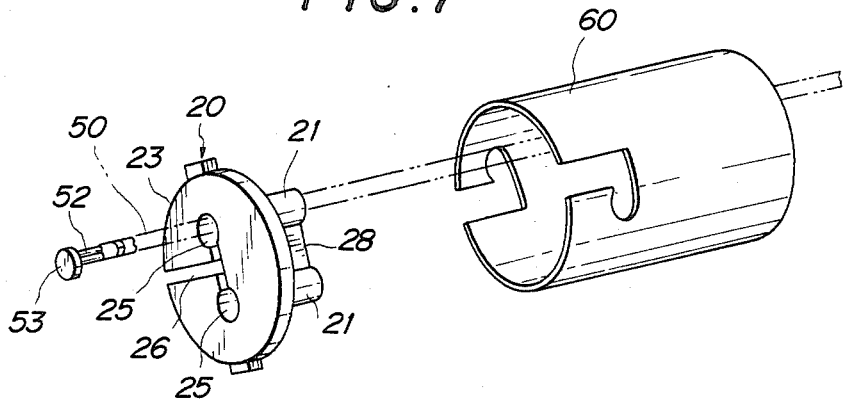
FIG. 7 is an exploded perspective view of an insulator of a second embodiment of the present invention.
Figure 8:
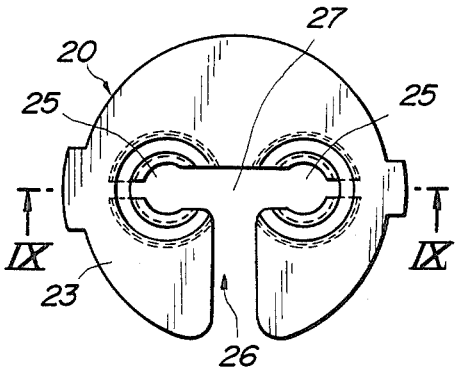
FIG. 8 is a top plan view of the insulator shown in FIG. 7.
Figure 10:
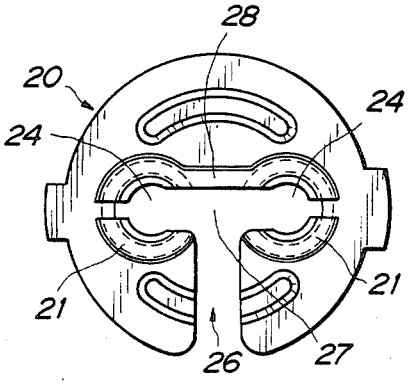
FIG. 10 is a bottom view of the insulator.
Figure 9:
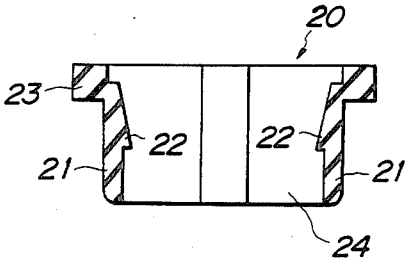
FIG. 9 is a vertical sectional view along IX—IX line in FIG. 8.
Figure 11:
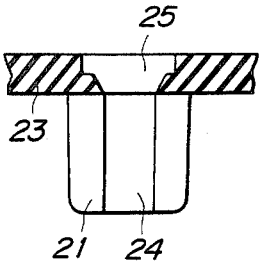
FIG. 11 is a partially sectional fragmentary schematic illustration of the insulator.

FIGS. 7, 8, 9, 10 and 11 illustrate a second embodiment of an insulator of the present invention. The insulator 20 of the second embodiment has two cylindrical members 21 which have holes 24 and are spaced each other by a partition 28 on one flange 23. The flange 23 has holes 25 aligned to the holes 24 of the cylindrical member 21. A cut out 26 is provided to the flange 23 and is connected to each hole 24 through a passage 27. An annular projection 22 is provided on an inner peripheral wall of each hole 24. In this embodiment, both cylindrical members 21 are connected by the reinforce partition 28 as shown in FIGS. 7 and 10. But, the cylindrical members can be independently formed without any partition or a reinforce thereof which is not shown in the drawings. The wire 50 is inserted and disposed in each hole 24 from the cutout 26 through the passage 27 as the same manner as the insulator of the first embodiment. The insulator 20 is fitted in a socket 60 which holds a bulb. But, it is not limited to the socket, and it is possible to use it in an appropriate any kind electric connector.

Figure 12:
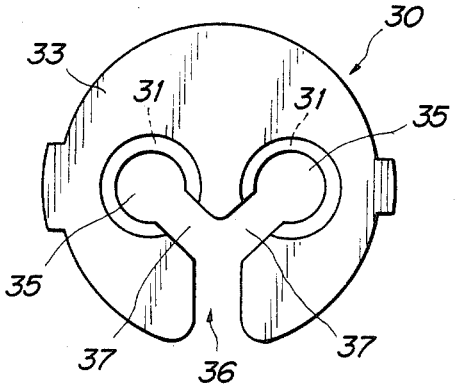
FIG. 12 is a top plan view of an insulator of a third embodiment of the present invention.

FIG. 12 illustrates a third embodiment of an insulator 30 of the present invention. The insulator 30 has a pair of cylindrical members 31 and a flange 33 which is formed in one united body with the cylindrical members. Each cylindrical member 31 has a hole, and the flange 33 also has holes 35 aligned to the holes of the cylindrical member 31. And the flange 33 has a cutout 36 and forked V-shaped passages 37 which are respectively connected to the holes of the cylindrical members 31 and of the flange 33. The holes of the cylindrical members are spaced by a plate member of the flange 33. Therefore, the terminals are prevented from short-circuiting with each other.

As explained above, since each embodiment provides the cutout which is connected to the hole of the cylindrical member of the insulator, it is not necessary to set the wire into the hole of the insulator prior to attachment of the terminals to the ends of the wire, and it becomes possible to automatically fix the terminals to the ends of the wire prior to setting the wire to the insulator which is cut at predetermined length. And, efficiency of manufacturing the wire and of fixation of the terminals to the ends of the wire is increased, and it is possible to set the terminal attached to the end of the wire to the insulator even after fixation of the terminals to the wire.

FIGS. 13, 14, 15, 16, 17 18 and 19 illustrate a fourth embodiment of the present invention. An electric wire 50 has electric terminals 51 and 52 at both ends, and the terminal 52 which has a head 53 is fitted to an insulator 40. The insulator 40 is comprised by a cylindrical member 41 and a flange 43 which is formed in one united body with the cylindrical member 41. The cylindrical member 41 has a plurality of small size holes 44 to pass the wire 50, and the flange 43 has a plurality of small size holes 45 which are somewhat large to hold the head 53 of the terminal 52 and are respectively aligned to the holes 44 of the cylindrical member 41 and have respectively shoulders on inner peripheral walls thereof.

Figure 15:
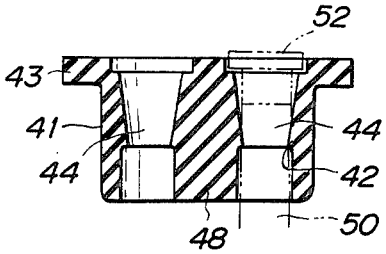
FIG. 15 is a vertical sectional view along XV—XV line in FIG. 14.
Figure 17:
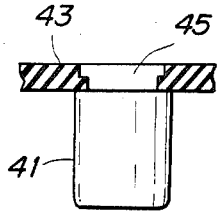
FIG. 17 is a partially sectional fragmentary schematic illustration of the insulator.
Figure 18:
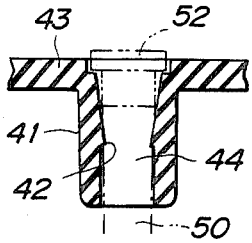
FIG. 18 is a vertical sectional view along XVIII—XVIII line in FIG. 14.
Figure 19:
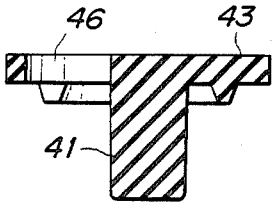
FIG. 19 is a vertical sectional view along XIX—XIX line in FIG. 14.

The wire 50 is passed through the hole 44, but the head 53 of the terminal 52 cannot pass through the hole 44. As shown in FIGS. 15 and 18, an annular projection 42 is provided on an inner peripheral wall of the hole 44 of the cylindrical member 41 to hold strongly a surrounding cover material of the wire 50. The annular projection 42 prevents the wire 50 from slipping and falling off to a direction of the flange 43. Accordingly, the wire 50 and its terminal 52 are held in the insulator 40 without falling off from the cylindrical member 41. As shown by phantom lines in FIGS. 15 and 18, in case that the wire 50 and the terminal 52 are held in the insulator 40, the head 53 of the terminal 42 is engaged with the hole 45 and supported on the shoulder of the hole 45 of the flange 43.

Figure 13:
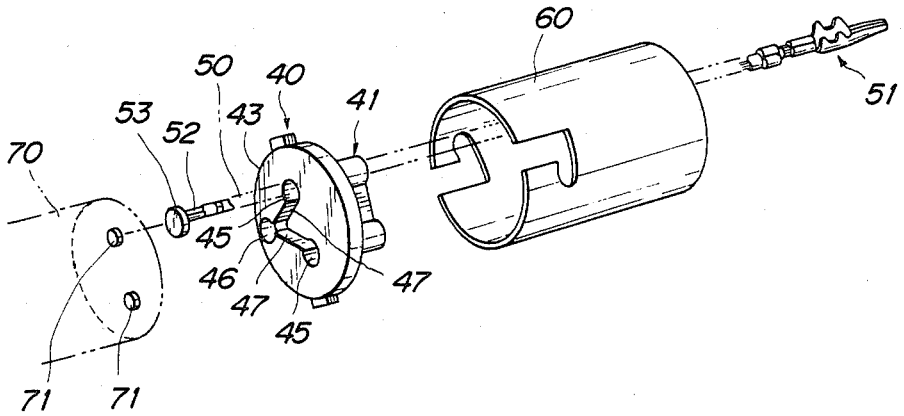
FIG. 13 is an exploded perspective view of an insulator of a fourth embodiment of the present invention.
Figure 14:
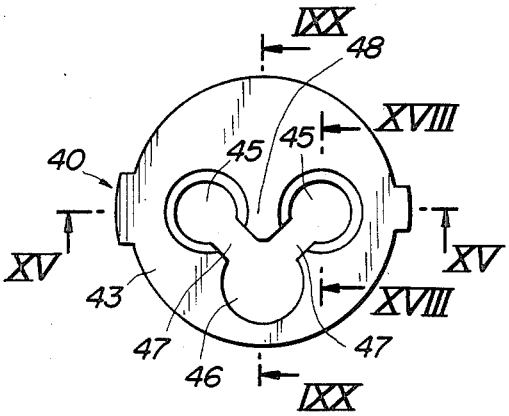
FIG. 14 is a top plan view of the insulator of the present invention.

The insulator 40 is mounted to a socket 60 shown in FIG. 13 for holding a bulb 70 or a lamp. But, the socket is not limited to this type, and an appropriate electric connector is used. As shown in FIG. 13, for example, each head 53 of the terminal 52 is connected to each end contact 71 of the bulb 70. Between the small diameter holes 44, 44, a partition 48 is provided to separate these holes, and the partition 48 forms a portion of the cylindrical member 41 and the flange 43.

Figure 16:
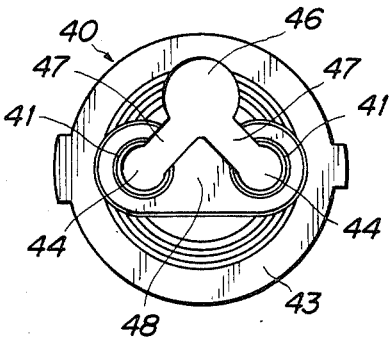
FIG. 16 is a bottom plan view of the insulator of the present invention.

A large diameter hole 46 is provided to the flange 43 through which the wire 50 and its terminals 51, 52 can be freely passed, and a plurality of passages 47 is formed between the large diameter hole 46 and each small diameter hole 44 of the cylindrical member 41 and the hole 45 of the flange 43. Passages 47 are formed from a first slit in the cylindrical member 41 and a second slit in flange 43. The passages 47 are provided as V-shaped as shown in FIG. 16, and the passages are able to be provided as T-shape between the small diameter holes and the large diameter hole 46. The passage 47 has a width to allow the wire 50 to move by pressing from the large diameter hole 46 to each of the small diameter holes 44.

From the construction of the present invention, by the provision of the large diameter hole 46 and the passages 47, even though the terminals 51 and 52 are attached to the both ends of the wire 50 prior to insertion of the wire in the hole 44 of the cylindrical member 41 and the aligned hole 45 of the flange 43, it is possible to dispose the terminal 52 on the insulator 40 due to the steps that firstly, the head 53 of the terminal 52 is inserted and passed through the large diameter hole 46, and the wire 50 is placed in the hole 46, secondly, the wire 50 is moved by pressing through the passage 47 and is placed in the small diameter hole 44, and lastly, the wire 50 is pulled inward to set the terminal 52 in the small diameter hole 44 and to support the head 53 of the terminal 52 on the shoulder of the hole 45 of the flange 43.

Therefore, is is not necessary to insert the wire in the hole 44 prior to attaching the terminals to the wire, accordingly the terminals 51 and 52 can be automatically attached and fixed to the both ends of the wire 50.

And, because the passages 47 are not provided straightly form a small diameter hole 44 to the other small diameter hole 44, and the partition 48 is provided between the both small holes 44, both termimals 52 and 52 set on the insulator 40 are prevented from the electrical short-circuit therebetween. Moreover, the cylindrical member 41 and the flange 43 of the insulator 40 are not cut out at any outer peripheral surface, and the peripheral surface is closed, therefore, the strength of the whole body of the insulator is not reduced.

In the above stated embodiment, a plurality of small diameter holes 44 are provided. But, it is possible to provide single small diameter hole with one passage, and further, is it possible to provide a plurality of pairs of single small diameter hole and single large diameter hole to the insulator which are not shown in the drawings.

In accordance with the present invention, the large diameter hole and the passage which connects the large diameter hole and the small diameter hole for passing the wire to the small hole are provided to the insulator, therefore it is not necessary to set the wire in the small diameter hole of the insulator prior to fixation of the terminals on the ends of the wire, and it becomes possible to automatically fix the terminals to the ends of the wire prior to setting the wire to the insulator which is cut at predetermined length. And, efficiency of manufacturing the wire and of fixation of the terminals to the ends of the wire is increased, and it is possible to set the terminal attached to the end of the wire to the insulator even after fixation of the insulator in the socket.

The invention may be embodied in other specific forms without departing from its spirit or essential characteristics. The described embodiment is to be considered in all respects only as illustrative and not limiting, and the scope of the invention is, therefore, indicated by the appendant claims rather than by the foregoing description. All changes which come within the meaning and range of equivalency of the claims are to be considered within their scope. Consequently, it is recognized that many variations may be made without departing from the scope or spirit of the present invention.

I claim:

1. An insulator for an electric terminal attached to an electric wire, comprising:

at least one cylindrical member having a first hole adapted to receive the electric wire therein, and a first slit to allow the electric wire to pass therethrough for placing the electric wire in the first hole through the first slit, and a flange integrally formed with and surrounding the cylindrical member and having at least one second hole aligned with the first hole of the cylindrical member, the diameter of the second hole being slightly larger than that of the first hole so that the electric terminal can be located in the second hole, a third hole having a diameter larger than that of the electric terminal to allow the electric terminal with the electric wire to pass longitudinally therethrough, and at least one second slit formed between the second and third holes and aligned with the first slit to allow the electric wire to pass laterally through said first and second slits so that the electric terminal is located in the second hole and the electric wire is located in the first hole.

2. An insulator according to claim 1, wherein said cylindrical member further includes an annular projection extending into the first hole to securly hold the electric wire therein the prevent the electric wire with the electric terminal from moving in the insulator.

3. An insulator according to claim 2, wherein said flange further includes an annular shoulder around the second hole to receive therein a part of the electric terminal.

4. An insulator according to claim 2, wherein a plurality of cylindrical members with first holes and first slits is integrally connected to the flange, said flange including a plurality of second holes aligned with the first holes respectively and a plurality of second slits formed between the second and third holes respectively so that a plurality of electric wires with electric terminals can be securely retained in the insulator.

5. An insulator according to claim 4, wherein the cylindrical members are separated by a partition situated between the adjacent two cylindrical members.

6. An insulator assembly comprising:

at least one electric wire having at least one electric terminal at one end, at least one cylindrical member having a first hole to receive the electric wire therein, and a first slit to allow the electric wire to pass therethrough for placing the electric wire in the first hole through the first slit, and a flange integrally formed with and surrounding the cylindrical member and having at least one second hole aligned with the first hole of the cylindrical member, the diameter of the second hole being slightly larger than that of the first hole so that the electric terminal can be located in the second hole, a third hole having a diameter larger than that of the electric terminal to allow the electric terminal with the electric wire to pass longitudinally therethrough, and at least one second slit formed between the second and third holes and aligned with the first slit to allow the electric wire to pass laterally through said first and second slits so that the electric terminal is located in the second hole and the electric wire is located in the first hole.

7. An insulator assembly according to claim 6, wherein said cylindrical member further includes an annular projection extending into the first hole to securely hold the electric wire therein to prevent the electric wire with the electric terminal from moving in the insulator assembly.

8. An insulator assembly according to claim 7, wherein said flange further includes an annular shoulder around the second hole to receive therein a part of the electric terminal.

9. An insulator assembly according to claim 7, wherein a plurality of cylindrical members with first holes and first slits is integrally connected to the flange, said flange including a plurality of second holes aligned with the first holes respectively and a plurality of second slits formed between the second and third holes respectively so that a plurality of electric wires with electric terminals can be securely retained in the insulator.

10. An insulator assembly according to claim 9, wherein the cylindrical members are separated by a partition situated between the adjacent two cylindrical members.

* * * * *